US010931034B2

(12) United States Patent
Zhu et al.

(10) Patent No.: US 10,931,034 B2
(45) Date of Patent: Feb. 23, 2021

(54) ANTENNA SYSTEM AND MOBILE TERMINAL

(71) Applicant: AAC Technologies Pte. Ltd., Singapore (SG)

(72) Inventors: Yufei Zhu, Shenzhen (CN); Mingjun Hang, Shenzhen (CN); Dawei Shi, Shenzhen (CN); Kai Dong, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 32 days.

(21) Appl. No.: 16/524,054

(22) Filed: Jul. 27, 2019

(65) Prior Publication Data

US 2020/0044364 A1 Feb. 6, 2020

(30) Foreign Application Priority Data

Aug. 3, 2018 (CN) ..... 201810878294.6

(51) Int. Cl.

| | |
|---|---|
| ***H01Q 21/28*** | (2006.01) |
| ***H01Q 5/50*** | (2015.01) |
| ***H01Q 5/328*** | (2015.01) |
| ***H01Q 1/24*** | (2006.01) |

(52) U.S. Cl.

CPC ..... *H01Q 21/28* (2013.01); *H01Q 1/241* (2013.01); *H01Q 5/328* (2015.01); *H01Q 5/50* (2015.01)

(58) Field of Classification Search

None

See application file for complete search history.

(56) References Cited

U.S. PATENT DOCUMENTS

| | | | | |
|---|---|---|---|---|
| 10,431,872 | B1 * | 10/2019 | Kim | H01Q 1/243 |
| 2018/0026333 | A1 * | 1/2018 | Lee | H01Q 13/18 343/702 |
| 2018/0026335 | A1 * | 1/2018 | Lee | H01Q 13/18 343/702 |
| 2018/0026344 | A1 * | 1/2018 | Lee | H01Q 1/2291 343/702 |
| 2018/0026350 | A1 * | 1/2018 | Hung | H01Q 1/243 455/575.7 |
| 2018/0026353 | A1 * | 1/2018 | Tseng | H01Q 13/10 455/575.7 |
| 2018/0026360 | A1 * | 1/2018 | Lee | H01Q 5/371 343/872 |
| 2018/0026370 | A1 * | 1/2018 | Lee | H01Q 1/243 343/810 |
| 2018/0062244 | A1 * | 3/2018 | Huang | H01Q 1/243 |

(Continued)

*Primary Examiner* — Crystal L Hammond

(74) *Attorney, Agent, or Firm* — W&G Law Group LLP

(57) ABSTRACT

A mobile communication device is provided. The mobile communication device includes: a metal housing, a diversity antenna unit, an integrated antenna unit, a first main antenna unit, a second main antenna unit, and a main board. Compared with the related art, with the antenna system provided by the present disclosure, the diversity antenna unit, the integrated antenna unit, the first main antenna unit, and the second main antenna unit constitute 4×4 MIMO of an LTE Band3 and an LTE Band7, so that performance of the medium frequency and high frequency is improved; and the integrated antenna unit and the second main antenna unit constitute 2×2 MIMO of the Wi-Fi5G, so that performance of the Wi-Fi5G is improved.

9 Claims, 10 Drawing Sheets

(56) References Cited

U.S. PATENT DOCUMENTS

2018/0301787 A1* 10/2018 Han ..... H01Q 1/48
2018/0358686 A1* 12/2018 Park ..... H01Q 9/42
2018/0366817 A1* 12/2018 Sung ..... H01Q 1/243

* cited by examiner

ANTENNA SYSTEM AND MOBILE TERMINAL

TECHNICAL FIELD

The present disclosure relates to the field of communications technologies, and in particular, to an antenna system and a mobile terminal.

BACKGROUND

As the world standardization organization sets out to define a next generation of wireless networks, 5G vision is forcing researchers to change their thinking way. The spectral efficiency of 4G networks is not sufficient to provide the faster data transmission rate, low latency and high capacity. Therefore, there is a need for a wireless network that provides ubiquitous instantaneous mobile broadband data. A data rate is directly related to an available spectrum. According to Shannon's theorem, capacity is a function of a bandwidth (i.e., a frequency spectrum) and a channel noise.

In the related art, a communication device having a metal housing, such as a mobile phone, has become a mainstream structure of major brands of mobile phones. When designing an antenna of the mobile phone, a slit is provided on a housing. Generally, the slit extends through the housing along a width of the mobile phone to divide the housing into three parts, including two frames and a back housing. That is, the housing is of a three-fragment type. A feeding point on the main board is directly connected to the frame, so that the frame forms a radiator. However, with such an antenna system in which only the frame is used as the radiator, the medium and high frequency bandwidths of the formed antenna system are narrow, and the radiation efficiency is relatively low.

Therefore, it is necessary to provide a new antenna system to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
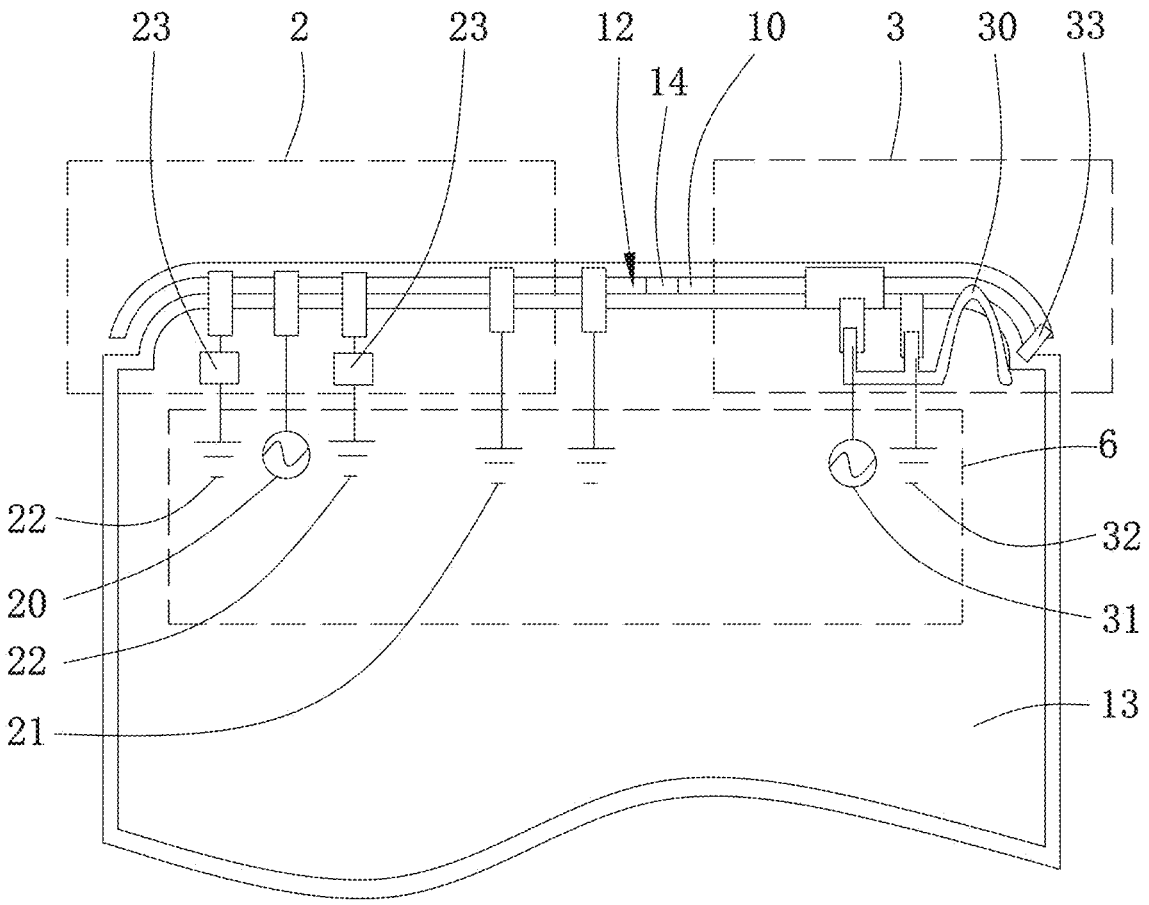
FIG. 1 is a structural schematic diagram of an antenna system according to an embodiment of the present disclosure.
Figure 2:
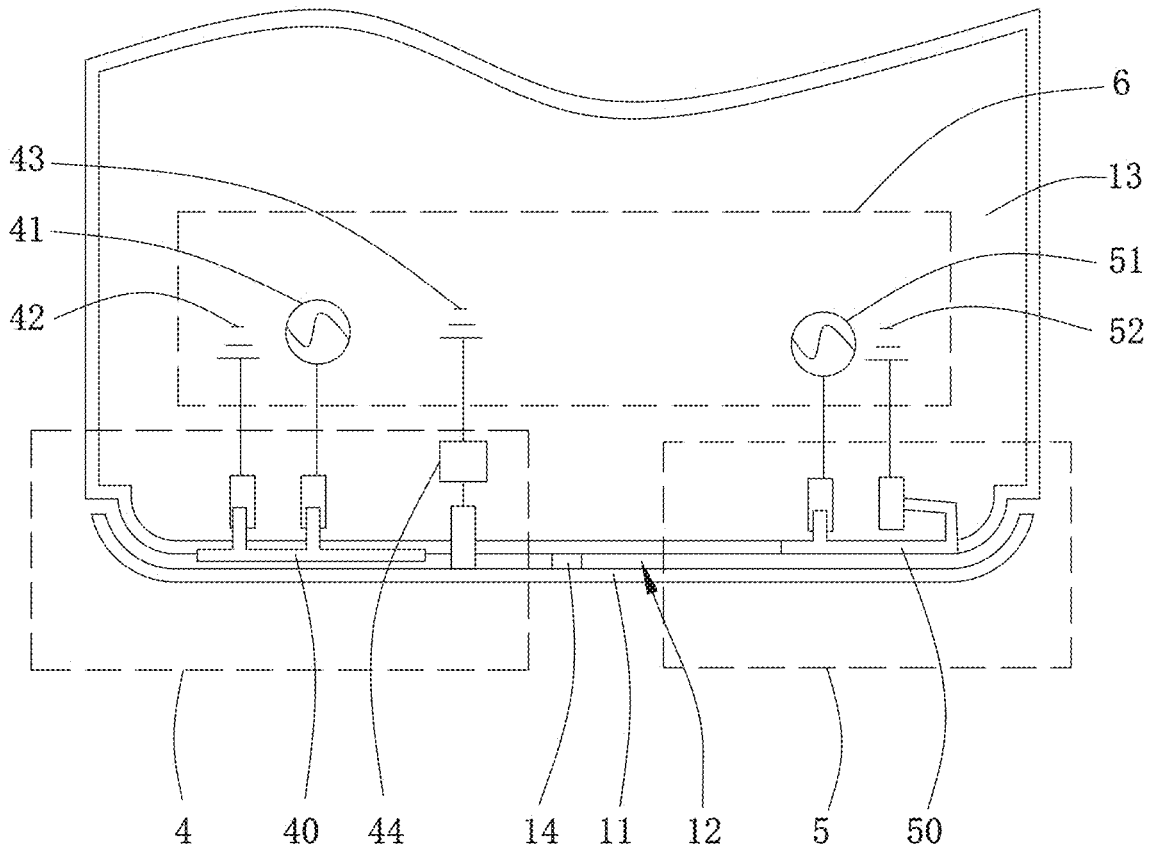
FIG. 2 is another structural schematic diagram of an antenna system according to an embodiment of the present disclosure.

Referring to FIGS. 1 and 2, the present disclosure provides an antenna system that can be used in a mobile terminal, such as a mobile phone. The antenna system includes a metal housing 1, a diversity antenna unit 2, an integrated antenna unit 3, a first main antenna unit 4, a second main antenna unit 5, and a main board 6. The metal housing 1 includes a top frame 10, a bottom frame 11, and a middle back housing 13 forming slits 12 with the top frame 10 and the bottom frame 11. The top frame 10 and the bottom frame 11 are connected to the middle back housing 13 by a connection rib 14.

The diversity antenna unit 2 includes a top frame 10, a first feeding terminal 20 connected to the top frame 10, a first ground terminal 21, two second ground terminals 22, and two antenna frequency tuning switches 23 connected in series between the top frame 10 and the two second ground terminals 22.

The antenna band tuning switch 23 includes a tunable capacitor (not shown). The antenna band tuning switch 23 has an off state and a capacitance-connecting state as follows.

When the antenna band tuning switch 23 is in an off state, the second ground terminal 21 is disconnected from the top frame 10.

When the antenna band tuning switch 23 is in a capacitance-connecting state, the second ground terminal 22 is connected to the top frame 10 through the adjustable capacitance.

Switch of tuning can be achieved by setting two antenna band tuning switches 23. The working frequency bands of 790-960 MHz, 1710-2170 MHz and 2300-2690 MHz can be achieved without setting additional antenna traces.

Figure 3:
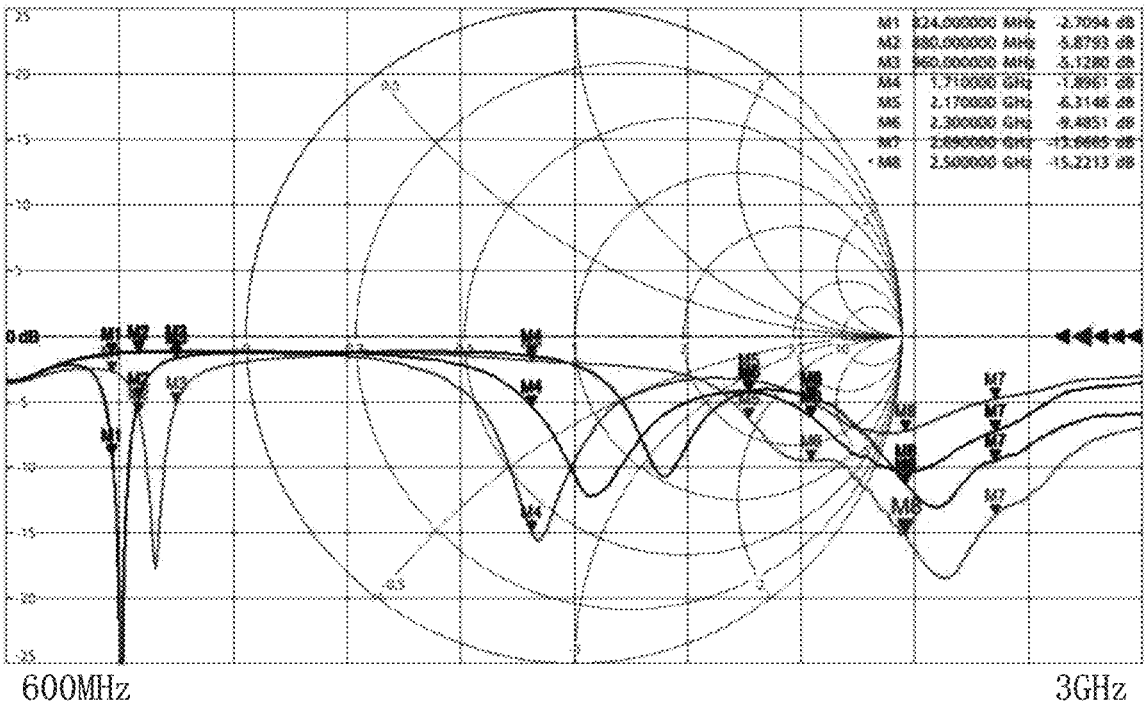
FIG. 3 is a graph showing return loss of a diversity antenna unit of an antenna system according to an embodiment of the present disclosure.

Referring to FIG. 3, taking eight working frequency points, M1 to M8, for observation, it can be seen that the three working frequency bands of 790-960 MHz, 1710-2170 MHz and 2300-2690 MHz can meet the actual requirements.

Figure 4:
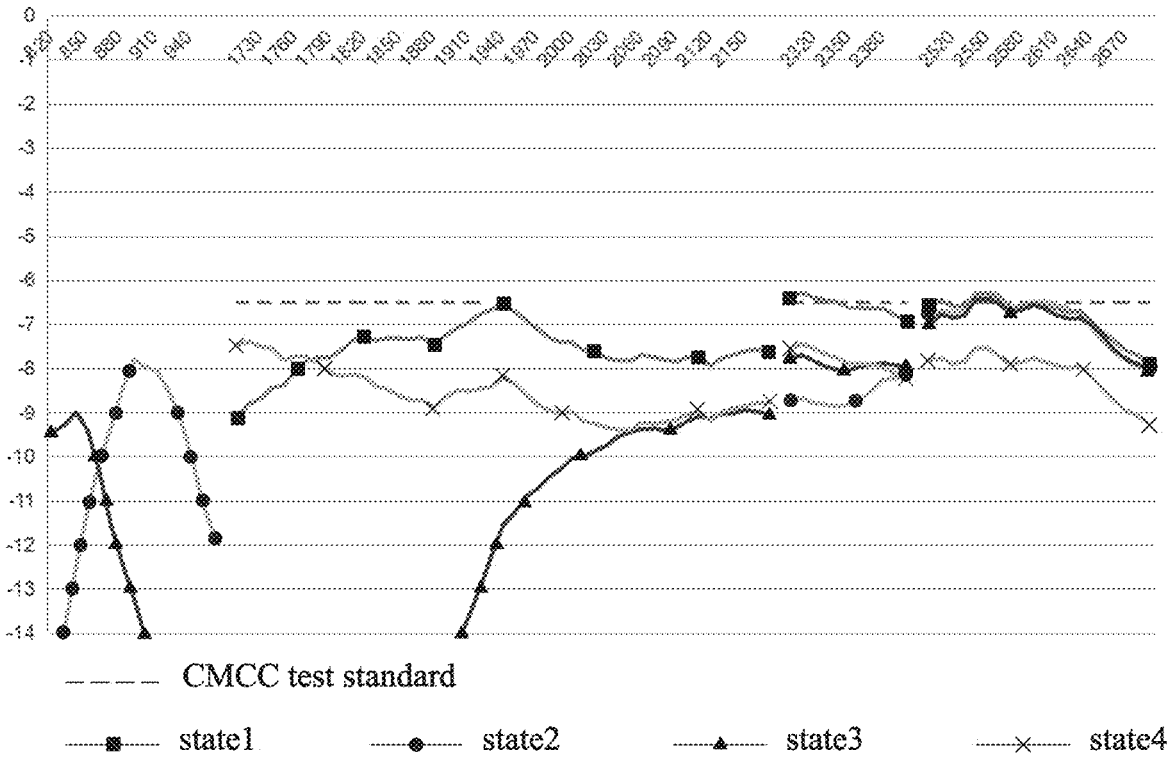
FIG. 4 is a graph showing passive efficiency of a diversity antenna unit of an antenna system according to an embodiment of the present disclosure.

FIG. 4 shows passive efficiency in four different states. It can be seen that the diversity antenna unit 2 has high passive efficiency and is stable at the three working frequency bands of 790-960 MHz, 1710-2170 MHz and 2300-2690 MHz, especially at the medium and high frequency bands.

The integrated antenna unit 3 includes a top frame 10, a second antenna 33, a first antenna 30, a second feeding terminal 31 and a third ground terminal 32. The second antenna 33 is connected to an end of the top frame 10. The first antenna 30 is coupled to the top frame 10. Each of the second feeding terminal 31 and the third ground terminal 32 is connected to the first antenna 30.

Figure 5:
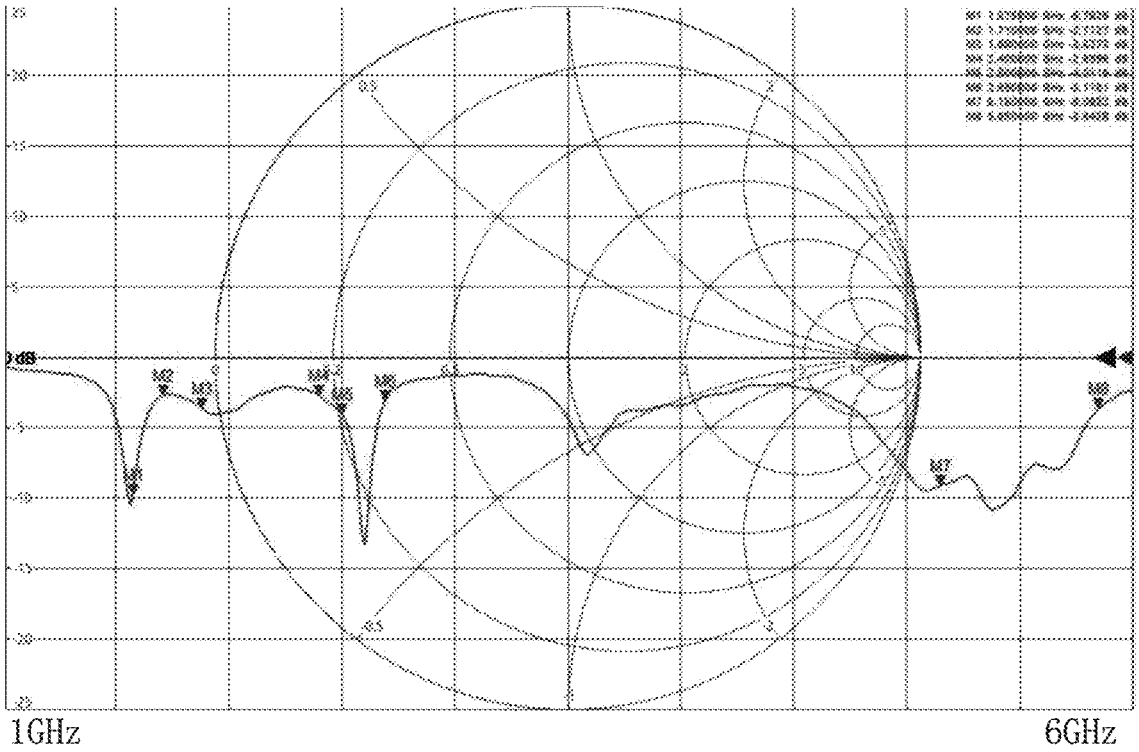
FIG. 5 is a graph showing return loss of an integrated antenna unit in an antenna system according to an embodiment of the present disclosure.

Referring to FIG. 5, which is a graph showing return loss of an integrated antenna unit in an antenna system according to an embodiment of the present disclosure, taking eight working frequency points, M1 to M8, for observation, it can be seen that GPS (1550-1620 MHz), Wi-Fi 2.4G (2400-2500 MHz), Wi-Fi5G (5150-5850 MHz), LTE Band 3 (1710-1880 MHz) and LTE Band 7 (2500-2690 MHz) can meet the actual requirements and have excellent performance at the medium frequency band and the high frequency band.

Figure 6:
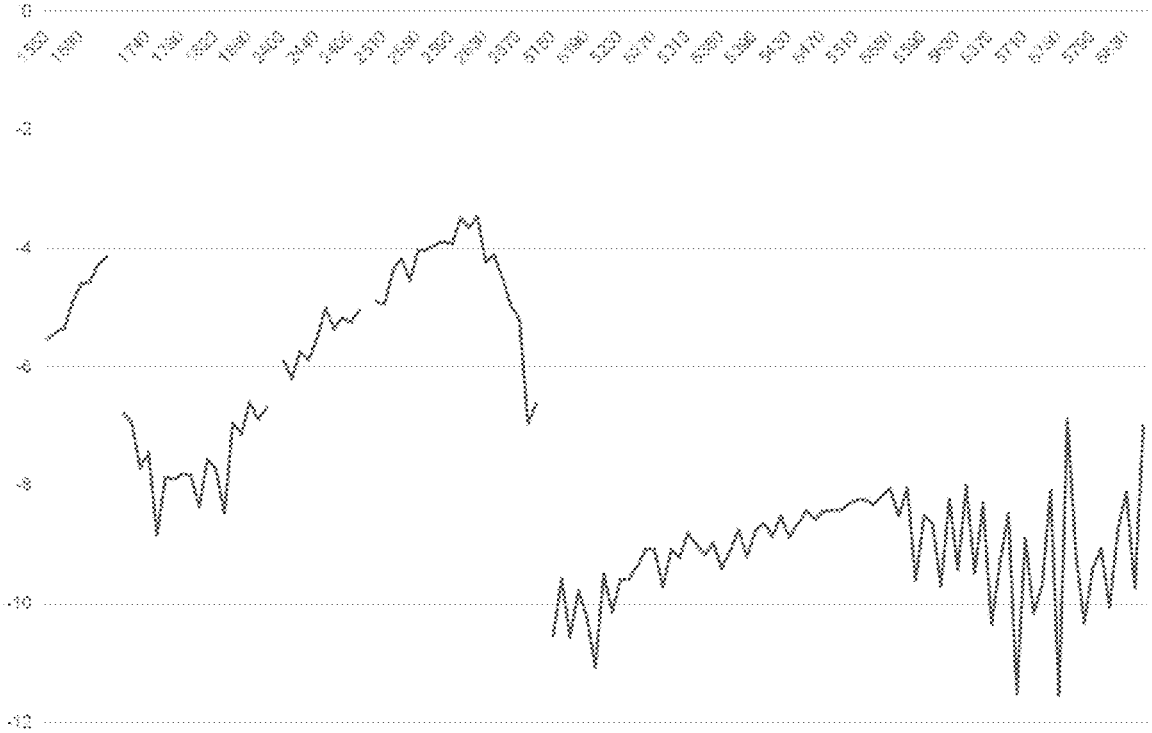
FIG. 6 is a graph showing passive efficiency of an integrated antenna unit in an antenna system according to an embodiment of the present disclosure.

Referring to FIG. 6, which is a graph showing passive efficiency of an integrated antenna unit in an antenna system according to an embodiment of the present disclosure, it can be seen that the better efficiency can be achieved in the working frequency band.

The first main antenna unit 4 includes a bottom frame 11, a first main antenna 40, a third feeding terminal 41, a fourth ground terminal 42, a fifth ground terminal 43 and a switch 44. The first main antenna 40 is coupled to the bottom frame 11. Each of the third feeding terminal 41, the fourth ground terminal 42 and the fifth ground terminal 43 is connected to the first main antenna 40. The switch 44 is connected in series between the first main antenna 40 and the fifth ground terminal 43. The switch 44 is composed of discrete components. That is to say, the switch 44 may be formed by means of simulation using electronic components such as a resistor, a capacitor, a transistor and the like. In other embodiments, the switch may be configured as a tuning switch.

Figure 8:
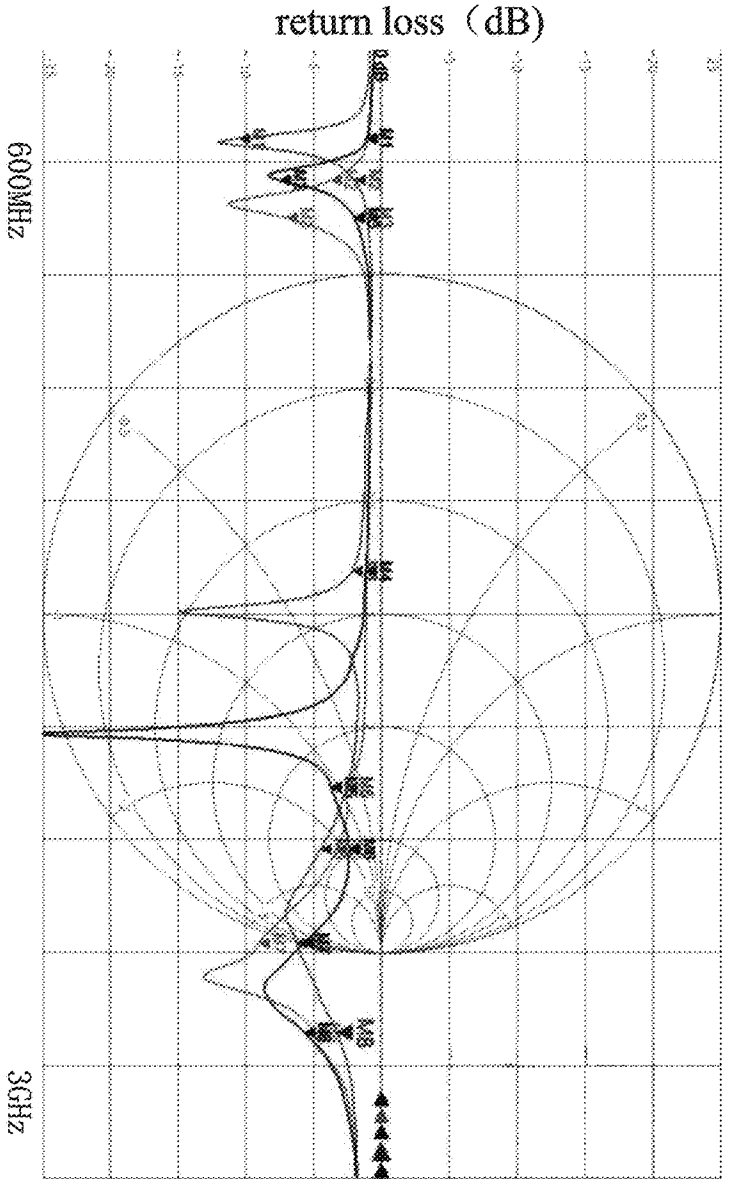
FIG. 8 is a graph showing return loss of a first main antenna unit of an antenna system according to an embodiment of the present disclosure.

Referring to FIG. 8, the first main antenna unit 4 has three working states, and the working frequency bands are 790-960 MHz, 1710-1880 MHz, and 2300-2690 MHz.

Figure 7:
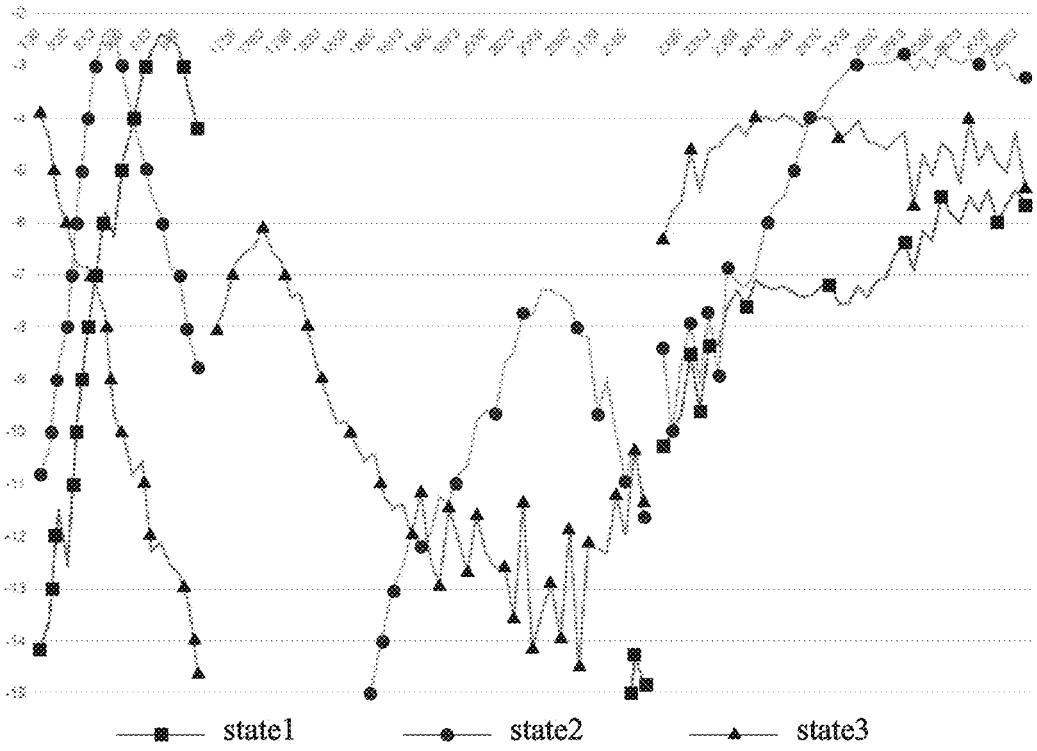
FIG. 7 is a graph showing passive efficiency of a first main antenna unit of an antenna system according to an embodiment of the present disclosure.

Referring to FIG. 7, which is a graph showing passive efficiency of the first main antenna unit of the antenna system according to an embodiment of the present disclosure, it can be seen from the passive efficiency in three different states that all of three states have high passive efficiency.

The second main antenna unit 5 includes a bottom frame 11, a second main antenna 50, a fourth feeding terminal 51 and a sixth ground terminal 52. The second main antenna 50 is coupled to the bottom frame 11. Each of the fourth feeding terminals 51 and the sixth ground terminal 52 is connected to the second main antenna 50.

Figure 10:
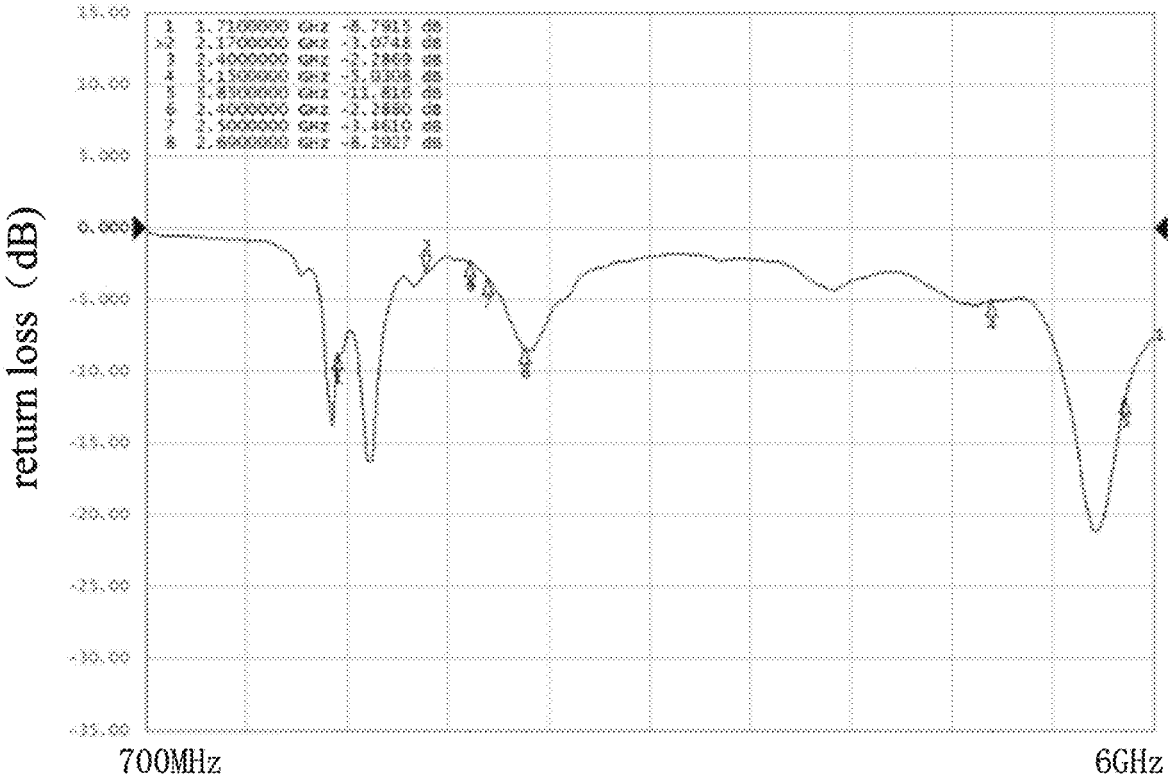
FIG. 10 is a graph showing return loss of a second main antenna unit of an antenna system according to an embodiment of the present disclosure.

Referring to FIG. 10, the working frequency bands of the second main antenna unit are 1710-2170 MHz, 2500-2690 MHz and 5150 MHz-5850 MHz.

Figure 9:
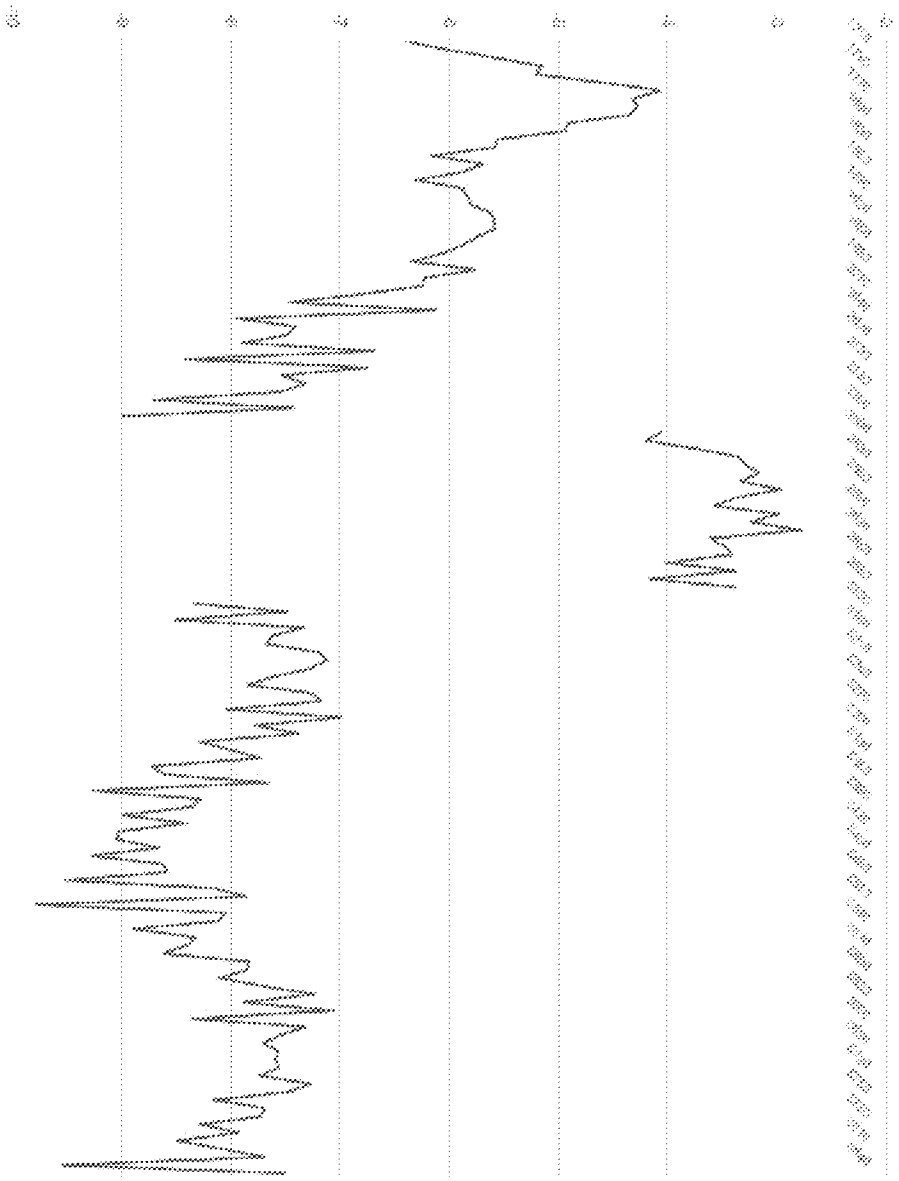
FIG. 9 is a graph showing passive efficiency of a second main antenna unit of an antenna system according to an embodiment of the present disclosure.

Referring to FIG. 9, which is a graph showing passive efficiency of a second main antenna unit of the antenna system according to an embodiment of the present disclosure, it can be seen that the passive efficiency is high in the working frequency band.

The antenna system provided by the present disclosure further includes a bracket (not shown) received in the metal housing 1. Each of the first antenna 30, the second antenna 33, the first main antenna 40, and the second main antenna 50 is formed on a surface of the bracket. Preferably, the bracket is a plastic bracket.

It should be noted that in FIGS. 4, 6, 7, and 9, the abscissa is frequency with a unit of MHz, and the ordinate is efficiency with a unit of dB.

In a preferred embodiment of the present disclosure, the main board 6 is provided opposite to the metal housing 1. Each of the first feeding terminal 20, the second feeding terminal 31, the third feeding terminal 41, the fourth feeding terminal 51, the first ground terminal 21, the second ground terminal 22, the third ground terminal 32, the fourth ground terminal 42, the fifth ground terminal 43 and the sixth ground terminal 52 is provided on the main board 6.

In fact, each of the diversity antenna unit 2, the integrated antenna unit 3, the first main antenna unit 4, and the second main antenna unit 5 in the antenna system provided by the present disclosure includes LTE Band3 (1710-1880 MHz) and LTE Band7 (2500-2690 MHz), which can form 4×4 MIMO of LTE Band3 and LTE Band7, thereby improving the medium and high frequency performance of the antenna system. Meanwhile, each of the integrated antenna unit 3 and the second main antenna unit 5 includes Wi-Fi5G (5150-5850 MHz), which can achieve 2×2 MIMO of Wi-Fi5G, thereby improving Wi-Fi performance.

The present disclosure also provides a mobile terminal including the antenna system, e.g., a mobile communication terminal such as a mobile phone.

Compared with the related art, the antenna system provided by the present disclosure has the following beneficial effects. The antenna frequency band tuning switch can be used to select different states, and the medium and high frequency bandwidth of the antenna system can be tuned to increase the bandwidth of the medium and the high frequency, so that the wave loss is low and the antenna efficiency is high. Meanwhile, the diversity antenna unit, the integrated antenna unit, the first main antenna unit and the second main antenna unit constitute 4×4 MIMO of LTE Band3 and LTE Band7, so that the medium and high frequency performance is improved. The integrated antenna unit and the second main antenna unit constitute 2×2 MIMO of Wi-Fi 5G, so that the performance of Wi-Fi5G is improved.

The above are only preferred embodiments of the present disclosure. Here, it should be noted that those skilled in the art can make modifications without departing from the inventive concept of the present disclosure, but these shall fall into the protection scope of the present disclosure.

What is claimed is:

1. An antenna system, comprising:

a metal housing comprising a top frame, a bottom frame and a middle back housing, the middle back housing forming a slit with each of the top frame and the bottom frame, and the top frame and the bottom frame being connected to the middle back housing by a connection rib;

a diversity antenna unit comprising a top frame, a first feeding terminal connected to the top frame, a first ground terminal, two second ground terminals, and two antenna frequency tuning switches connected in series between the top frame and the two second ground terminals;

an integrated antenna unit comprising a top frame, a second antenna connected to an end of the top frame, a first antenna coupled to the top frame, a second feeding terminal and a third feeding terminal, each of the second feeding terminal and the third feeding terminal being connected to the first antenna;

a first main antenna unit comprising a bottom frame, a first main antenna coupled to the bottom frame, a third feeding terminal, a fourth ground terminal, a fifth ground terminal connected to the bottom frame, and a switch connected in series between the bottom frame and the fifth ground terminal, each of the third feeding terminal and the fourth ground terminal being connected to the first main antenna;

a second main antenna unit comprising a bottom frame, a second main antenna coupled to the bottom frame, a fourth feeding terminal and a sixth ground terminal, each of the fourth feeding terminal and the sixth ground terminal being connected to the second main antenna; and a main board provided opposite to the metal housing, wherein each of the first feeding terminal, the second feeding terminal, the third feeding terminal, the fourth feeding terminal, the first ground terminal, the second ground terminal, the third ground terminal, the fourth ground terminal and the sixth ground terminal is provided on the main board.

2. The antenna system as described in claim 1, wherein the diversity antenna unit has working frequency bands of 790-960 MHz, 1710-2170 MHz and 2300-2690 MHz.

3. A mobile terminal, comprising the antenna system as described in claim 2.

4. The antenna system as described in claim 1, wherein the integrated antenna unit has working frequency bands of 1550-1620 MHz, 2400-2500 MHz, 5150-5850 MHz, 1710-1880 MHz and 2500-2690 MHz.

5. The antenna system as described in claim 4, wherein the first main antenna unit has working frequency bands of 790-960 MHz, 1710-1880 MHz and 2300-2690 MHz.

6. The antenna system as described in claim 1, wherein the first main antenna unit has working frequency bands of 790-960 MHz, 1710-1880 MHz and 2300-2690 MHz.

7. The antenna system as described in claim 1, wherein the second main antenna unit has working frequency bands of 1710-2170 MHz, 2500-2690 MHz, and 5150-5850 MHz.

8. The antenna system as described in claim 1, wherein the diversity antenna unit, the integrated antenna unit, the first main antenna unit and the second main antenna unit constitute 4×4 MIMO of an LTE Band3 and an LTE Band7, and the integrated antenna unit and the second main antenna unit constitute 2×2 MIMO of Wi-Fi5G.

9. A mobile terminal, comprising the antenna system as described in claim 1.

* * * * *